US008495830B2

(12) United States Patent
Price

(10) Patent No.: US 8,495,830 B2
(45) Date of Patent: Jul. 30, 2013

(54) QUICK EXCHANGE FRAMING SYSTEM AND METHOD OF MANUFACTURE

(76) Inventor: Rodney Price, Paola, KS (US)

( * ) Notice: Subject to any disclaimer, the term of this patent is extended or adjusted under 35 U.S.C. 154(b) by 0 days.

(21) Appl. No.: 13/249,857

(22) Filed: Sep. 30, 2011

(65) Prior Publication Data

US 2012/0090211 A1 Apr. 19, 2012

Related U.S. Application Data

(60) Provisional application No. 61/392,780, filed on Oct. 13, 2010.

(51) Int. Cl.
*A47G 1/06* (2006.01)

(52) U.S. Cl.
USPC ..... 40/711; 40/611.01; 40/725; 40/757; 40/781; 40/790; 40/792

(58) Field of Classification Search
USPC .. 40/768, 790–794, 711, 764, 611.06–611.09
See application file for complete search history.

(56) References Cited

U.S. PATENT DOCUMENTS

| | | | | |
|---|---|---|---|---|
| 3,899,844 | A * | 8/1975 | Munn | 40/794 |
| 4,750,282 | A * | 6/1988 | Zennedjian | 40/792 |
| 4,939,858 | A * | 7/1990 | Dailey | 40/732 |
| 5,012,600 | A * | 5/1991 | Wang | 40/737 |
| 5,199,201 | A * | 4/1993 | Vilims | 40/792 |
| 5,269,083 | A * | 12/1993 | Vampatella et al. | 40/711 |
| 5,335,434 | A * | 8/1994 | Shultz et al. | 40/766 |
| 6,519,886 | B1 * | 2/2003 | Johnson et al. | 40/790 |
| 6,742,296 | B2 * | 6/2004 | Johnson et al. | 40/790 |
| 6,745,508 | B1 * | 6/2004 | Ngan | 40/642.02 |
| 6,868,630 | B2 * | 3/2005 | Kim | 40/711 |
| 6,889,458 | B2 * | 5/2005 | Copley | 40/711 |
| 7,587,847 | B2 * | 9/2009 | Lasher | 40/611.01 |
| 2002/0162262 | A1 | 11/2002 | Angone, III | |
| 2005/0028417 | A1 * | 2/2005 | Kim | 40/711 |
| 2005/0044767 | A1 * | 3/2005 | Lasher | 40/757 |
| 2006/0185210 | A1 * | 8/2006 | Beigel | 40/711 |
| 2007/0204500 | A1 * | 9/2007 | Splittgerber | 40/781 |

* cited by examiner

*Primary Examiner* — Joanne Silbermann
*Assistant Examiner* — Shin Kim
(74) *Attorney, Agent, or Firm* — Hovey Williams LLP

(57) ABSTRACT

A quick exchange framing system having two frames that are assembled together via a quick-release means such as a magnetic or friction force to provide easy access to a display, such as a picture or document, for ease in exchanging the display.

18 Claims, 5 Drawing Sheets

QUICK EXCHANGE FRAMING SYSTEM AND METHOD OF MANUFACTURE

CROSS-REFERENCE TO RELATED APPLICATIONS

This patent application claims priority to U.S. Patent Application Ser. No. 61/392,780 filed Oct. 13, 2010, the entire contents of which is incorporated herein by reference in its entirety.

BACKGROUND OF THE INVENTION

1. Field

Embodiments of the present invention relate to framing pictures, documents, and other visual media for display. More particularly, embodiments of the present invention relate to a frame and display system that facilitates exchanging and mounting pictures, documents, and other visual media.

2. Discussion of Related Art

There are many types of frames available to display pictures, documents, and other visual media. Conventional frames typically include a metal, wood, composite, or plastic trim that encompasses a generally central opening, such as a window where the visual media is securely displayed. The trim may be configured in various shapes such as square, rectangular, circular, or oval. A back plate is typically provided to secure the visual media against the trim and enable hanging of the conventional frame to a wall or other hanging surface.

To use a conventional frame to display visual media, a number of steps are required in the processes to initially install or exchange visual media to be displayed. Although conventional frames allow for the exchange of visual media as desired by users, often times, the users forego exchanging visual media due to the hassle presented by such processes.

When exchanging visual media using conventional frames, it is generally necessary to remove the entire conventional frame from its hanging surface and disassemble the back plate from the trim to remove previously-displayed visual media. Disassembling the back plate from the trim generally requires removing, bending, or rotating tabs, staples, hinges, or other fasteners. With some conventional frames, multiple tools may be required to complete the process of exchanging visual media.

Once the to-be displayed visual media is installed into the conventional frame, it is necessary to re-hang and level the conventional frame, which often becomes unleveled after removal from a wall or display area. Conventional frames may also become unleveled after inadvertent contact with the conventional frame, which displaces it from level once hung. If the conventional frame is hard mounted via permanent means to prevent inadvertent displacement, exchanging the displayed visual media of the conventional frame is especially difficult.

Accordingly, the process of exchanging visual media using conventional frames is generally unduly burdensome and time consuming.

SUMMARY OF THE INVENTION

The following brief description is provided to indicate the nature of the subject matter disclosed herein. While certain aspects of the present inventive concept are described below, the summary is not intended to limit the scope of the present inventive concept. Embodiments of the present inventive concept provide a system for framing and displaying pictures, documents, and/or other visual media, and a method of manufacturing such a system. The present inventive concept does not suffer from and remedies the deficiencies of conventional devices such as those previously set forth herein.

The present inventive concept provides an outer frame operable to securely receive and magnetically maintain an inner frame therein. The inner frame is operable to securely receive and maintain visual media therein via a resilient fastener, a magnet, and/or a friction-fit. The visual media may include one or more pieces of artwork, such as pictures, paintings, photographs, and/or the like, and/or one or more documents, such as licenses and/or diplomas. The system may accommodate visual media of various sizes. The system allows a user to exchange visual media quickly and without tools.

The aforementioned may be achieved in one aspect of the present invention by providing a media mount and display system including a support frame having a first receiver and a rear surface, a display frame sized and shaped to be at least partially received by the receiver of the support frame, the display frame having a second receiver operable to receive and display an object therein, and/or a magnetic system disposed between and operable to magnetically interconnect the support frame and the display frame relative to each other. The magnetic system may be operable to securely maintain the support frame and the display frame when the display frame is at least partially received by the first receiver of the support frame in an assembled configuration, and/or permit disassembly of the display frame and the support frame when a separation force is applied to the magnetic system.

The first receiver of the support frame may at least partially define a frame-support cavity that extends at least partially through a front of the support frame. The support frame may include an interior sidewall and may present a recessed surface spaced from the front of the support frame by the interior sidewall. The recessed surface and the interior sidewall may be operable to abuttingly receive the display frame in the assembled configuration.

The display frame may include an exterior sidewall and rearwardly-protruding portion spaced from the exterior sidewall. The rearwardly-protruding portion may be sized and shaped to nest within the frame-support cavity. The magnetic system may include a first portion secured to the recessed surface of the support frame and a second portion secured to the rearwardly-protruding portion of the display frame. The first and second portions of the magnetic system may abut each other in the assembled configuration. The first portion of the magnetic system may include a network of magnetically-attractive elongated strips mounted to and substantially flush with the recessed surface of the support frame.

The second portion of the magnetic system may include a network of magnets at least partially embedded in and substantially flush with the rearwardly-protruding portion of the display frame. The second receiver of the display frame may at least partially define a display cavity that extends at least partially through a rear of the display frame. The display cavity of the display frame may include an interior sidewall and may present a recessed surface spaced from the rear of the display frame by the interior sidewall. The recessed surface and the interior sidewall may be operable to abuttingly receive an object therein.

The display frame may include a fastener operable to be received in a plurality of slots located in the interior sidewall. The fastener may be operable to at least partially close the display cavity of the display frame to secure the object therein. The object may be one of a plate, an object to be displayed, and/or a plate and an object to be displayed. The separation force may be applied to the magnetic system when the display frame is pulled away from the support frame in a direction perpendicular to a plane defined by the rear surface of the support frame. The rear surface of the support frame may include wall-attachment means that is exposed through the first receiver of the support frame when the display frame and the support frame are disassembled.

The aforementioned may be achieved in another aspect of the present invention by providing a convertible media mount and display device including a support frame having a front surface, a rear surface, and a frame-support cavity extending at least partially through the front surface of the support frame, a display frame having a front surface and a rear surface, the rear surface including (i) a rearwardly-protruding portion sized and shaped to nest within the frame-support cavity, and (ii) a receiver extending at least partially through the rear surface of the display frame, the receiver operable to receive and display an object therein, and/or a magnetic system disposed between the support frame and the display frame. The magnetic system may be operable to maintain the device in an in-use configuration when the rearwardly-protruding portion of the display frame is nested with the frame-support cavity of the support frame, and/or permit conversion of the device from the in-use configuration to a non-use configuration when a force is applied to the magnetic system.

The support frame may include an interior sidewall and may present a recessed surface spaced from the front of the support frame by the interior sidewall. The recessed surface and the interior sidewall may be operable to abuttingly receive the display frame in the in-use configuration. The display frame may include an interior sidewall and may present a recessed surface spaced from the rear of the display frame by the interior sidewall. The recessed surface and the interior sidewall may be operable to receive therein one of a plate, an object to be displayed, and/or a plate and an object to be displayed.

The magnetic system may includes a network of magnetically-attractive elongated strips mounted to and substantially flush with the recessed surface of the support frame, and/or a network of magnets at least partially embedded in and substantially flush with the rearwardly-protruding portion of the display frame, the strips and the magnets abutting each other in the in-use configuration. The display frame may include a fastener operable to be received in a plurality of slots located in the interior sidewall of the display cavity. The fastener may be operable to at least partially close the display cavity of the display frame to secure the object therein.

The aforementioned may be achieved in another aspect of the present invention by providing a method of manufacturing a media mount and display system, the method including the steps of forming a support frame having a front surface, a rear surface, and a frame-support cavity extending at least partially through the front surface of the support frame, forming a display frame having a front surface and a rear surface, the rear surface including (i) a rearwardly-protruding portion sized and shaped to nest within the frame-support cavity, and (ii) a receiver extending at least partially through the rear surface of the display frame, the receiver operable to receive and display an object therein, and/or disposing a magnetic system between the support frame and the display frame. The magnetic system may be operable to maintain the device in an in-use configuration when the rearwardly-protruding portion of the display frame is nested with the frame-support cavity of the support frame, and/or permit conversion of the device from the in-use configuration to a non-use configuration when a force is applied to the magnetic system. The separation force may be applied to the magnetic system when the display frame is pulled away from the support frame in a direction perpendicular to a plane defined by the rear surface of the support frame.

The aforementioned may be achieved in another aspect of the present invention by providing a method of using a media mount and display system, the method including the steps of mounting a support frame on a wall or a table top, the support frame having a front surface, a rear surface, and in one or more embodiments, a frame-support cavity extending at least partially through the front surface of the support frame; removably mounting a display frame to the support frame, the display frame having a front surface and a rear surface, the rear surface including (i) a rearwardly-protruding portion sized and shaped to nest within the frame-support cavity, and/or (ii) a receiver extending at least partially through the rear surface of the display frame; and/or displaying an object within the receiver.

A magnetic system may be disposed between the support frame and the display frame to (i) maintain the device in an in-use configuration when the rearwardly-protruding portion of the display frame is nested with the frame-support cavity of the support frame, and/or (ii) permit conversion of the device from the in-use configuration to a non-use configuration when a force is applied to the magnetic system. The separation force may be applied to the magnetic system when the display frame is pulled away from the support frame in a direction generally perpendicular to a plane defined by the rear surface of the support frame.

The aforementioned may be achieved in another aspect of the present invention by providing a method of using a media mount and display system including the steps of providing a support frame having a first receiver and a rear surface, securing a display frame to the first receiver of the support frame, and/or displaying an object in a second receiver of the display frame. A magnetic system may be disposed between the support frame and the display frame to magnetically interconnect the support frame and the display frame relative to each other. The magnetic system may be operable to (i) securely maintain the support frame and the display frame when the display frame is at least partially received by the first receiver of the support frame in an assembled configuration, and/or (ii) permit disassembly of the display frame and the support frame when a separation force is applied to the magnetic system Additional aspects, advantages, and utilities of the present invention will be set forth in part in the description which follows and, in part, will be apparent to those skilled in the art upon review of the present description, or may be learned by practice of the present invention.

BRIEF DESCRIPTION OF THE DRAWINGS

Embodiments of the present invention are described in detail below with reference to the attached drawing figures, wherein.

Figure 2:
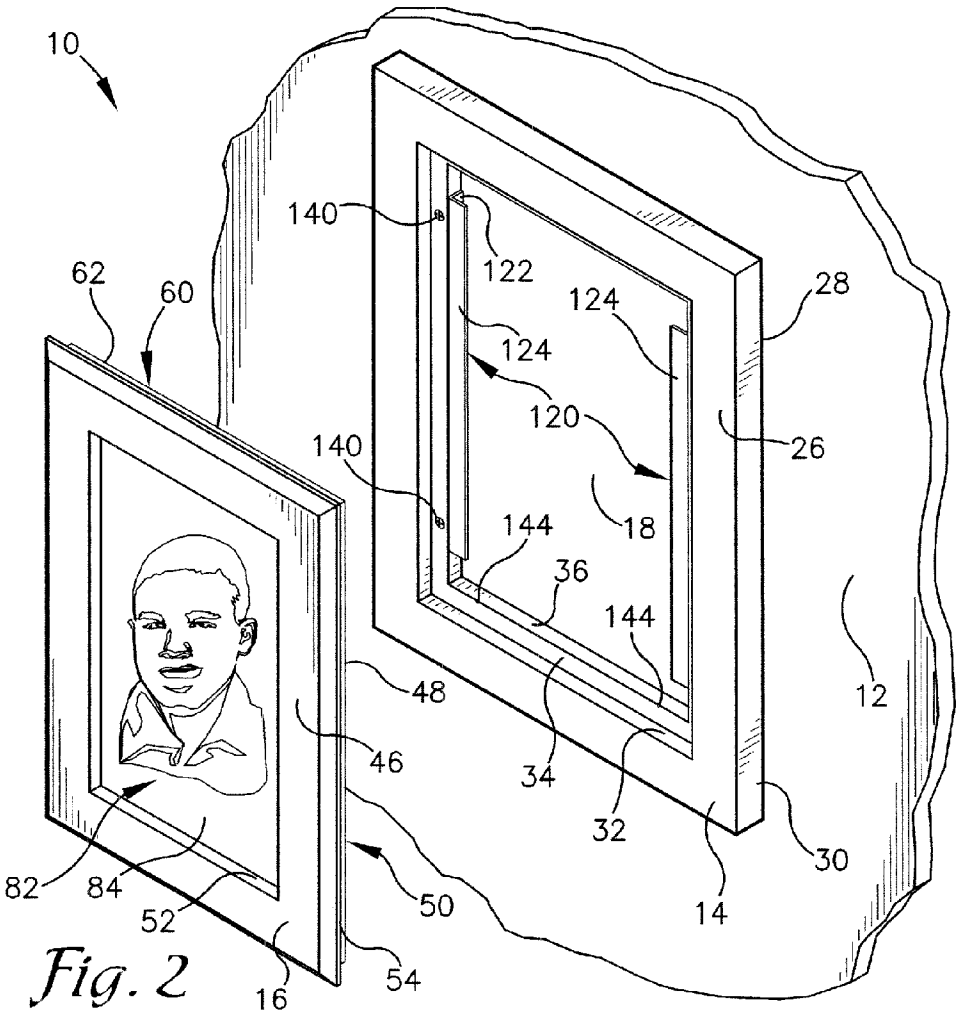
FIG. 2 is a front perspective view of the quick-exchange framing system illustrated in FIG. 1, illustrating the system in an exchange configuration.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE INVENTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 1:
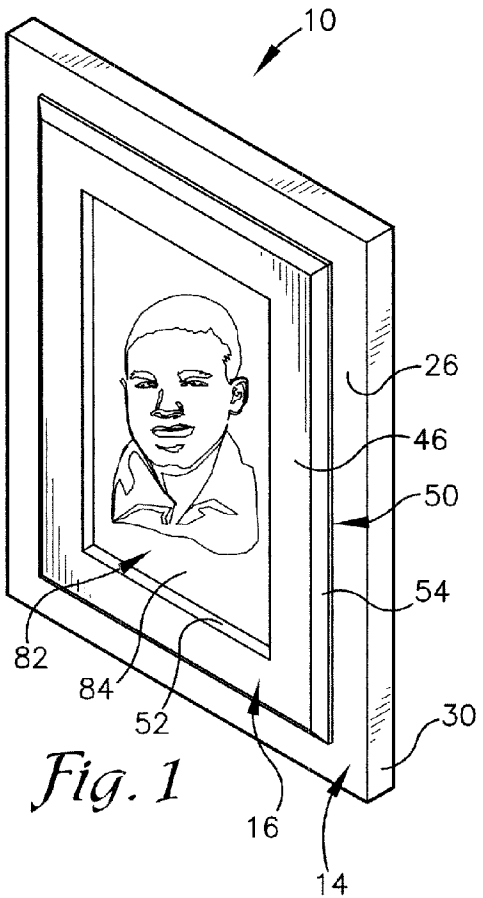
FIG. 1 is a front perspective view of quick-exchange framing system in accordance with an exemplary embodiment of the present invention, illustrating the system in a display configuration.

Turning to the drawings and particularly FIGS. 1 and 2, a quick-exchange framing system 10 is illustrated in use and mounted to a wall 12. The system 10 generally includes an outer wall-support frame 14 operable to be semi-permanently secured or mounted to the wall 12 or other mounting surface via a convenient thru-frame mounting system, and an inner display frame 16 operable to be removably secured to the support frame 14. In this manner, the system 10 is convertible to and from an in-use or display configuration, as illustrated in FIG. 1, and a non-use or visual media exchange configuration, as illustrated in FIG. 2. In the exemplary embodiment, the display frame 16 is sized and shaped to be received by and substantially nest within an aperture or frame-support cavity 18 that extends through the support frame 14. It is foreseen, however, that the frames 14, 16 may be of any different or corresponding size and/or shape without deviating from the scope of the present invention. For instance, the support frame 14 may be sized and shaped to be received by and substantially nest within the display frame 16.

The support frame 14 includes opposing front and rear surfaces 26, 28 spaced from each other by opposing outer and inner surfaces 30, 32. In the exemplary embodiment, the surfaces 26, 28, 30, 32 of the support frame 14 cooperate so that the support frame 14 is formed in a rectangular configuration. It is foreseen, however, that the support frame 14 may be of any geometric configuration, such as, but not limited to square, circular, oval, or polygonal, such as three-sided or four-sided, without deviating from the scope of the present invention.

Extending circumferentially from the inner surface 32 of the support frame 14 and parallel to the outer and inner surfaces 30, 32 is a recessed surface 34 that is spaced from the front surface 26 of the support frame 14 by the inner surface 32. The inner and recessed surfaces 32, 34 cooperatively define the frame-support cavity 18 and are sized and shaped to abuttingly receive the display frame 16. The recessed surface 34 has a perimeter edge 36.

The display frame 16 includes opposing front and rear surfaces 46, 48 spaced from each other by opposing outer and inner surfaces 50, 52. The outer surface 50 includes a beveled edge or transition surface 54. In the exemplary embodiment, the surfaces 46, 48, 50, 52 of the display frame 16 cooperate so that the display frame 16 is formed in a shape substantially similar to that of the support frame 14, that is, a rectangular configuration. It is foreseen, however, that the display frame 16 may be of a geometric configuration that is the same as or different than the geometric configuration of the support frame 14, such as, but not limited to square, circular, oval, or polygonal, such as three-sided or four-sided, without deviating from the scope of the present invention.

Figure 5:
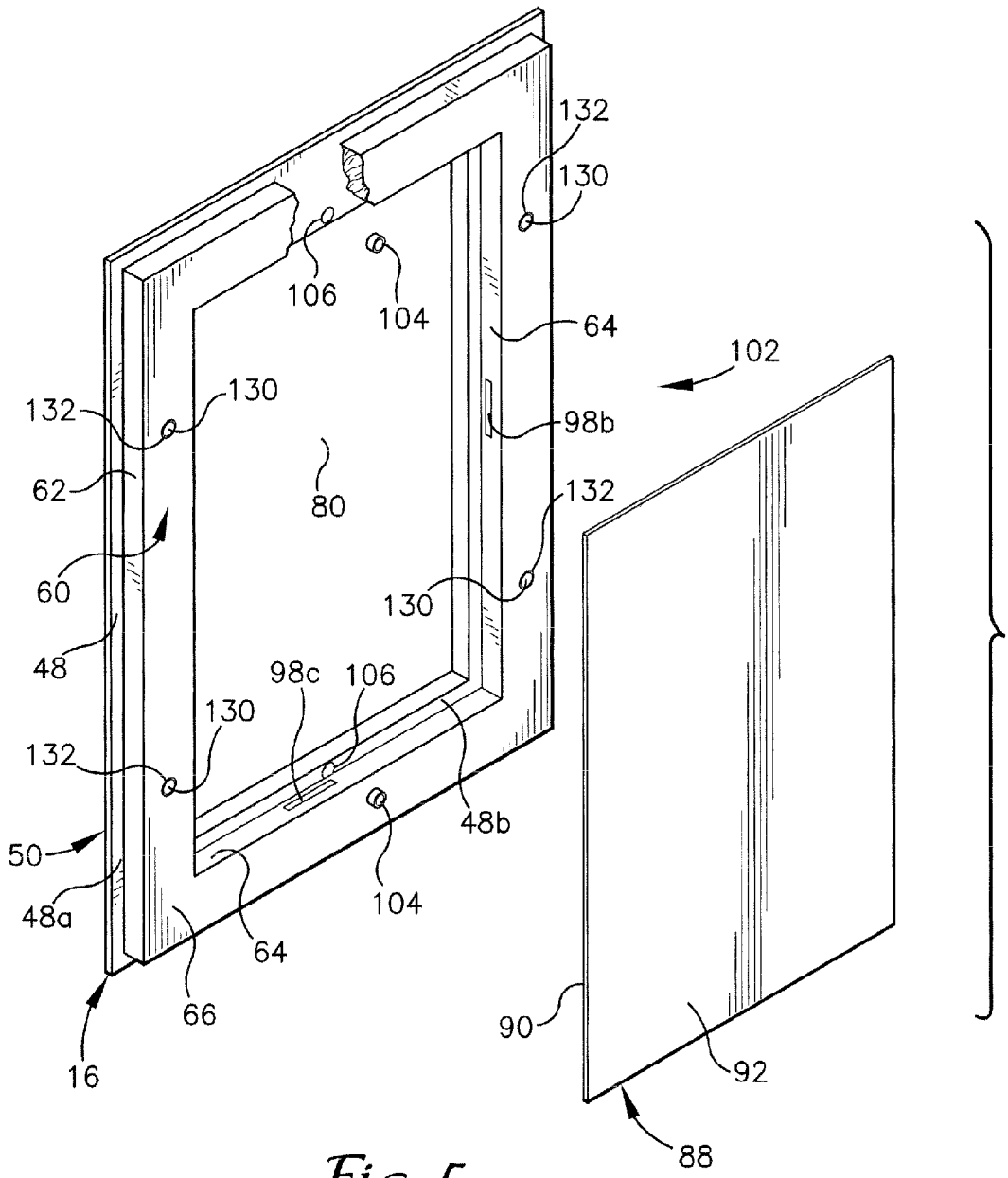
FIG. 5 is a rear perspective view of the quick-exchange framing system illustrated in FIG. 1, illustrating the system in an exchange configuration with a backplate.

With reference to FIG. 5, extending axially from and dividing the rear surface 48 of the display frame 16 into an outer rear surface **48*a* and an inner rear surface 48*b* is a rearwardly-protruding portion 60 that is circumferentially spaced from the outer surface 50 of the display frame 16 by the rear surface 52. The protruding portion 60 includes opposing interior and exterior side surfaces 62, 64 and a rear surface 66. The protruding portion 60 is sized and shaped to extend into the frame-support cavity 18 of the support frame 14 with the exterior and rear surfaces 62, 66 respectively abutting the inner and recessed surfaces 32, 34 of the support frame 14 to form a nesting engagement between the frames 14, 16. The engagement between the frames 14, 16**, which is further discussed hereafter, may be a friction-fit engagement or a loose-fit engagement.

The recessed surface 34 of the support frame 14 is spaced from the front surface 26 of the support frame 14 at a distance that is substantially equal to a distance the rearwardly-protruding portion 60 of the display frame 16 is spaced from the rear surface 48 of the display frame 16. Thus, the rear surface 48 of the display frame 16 abuts and partially conceals the front surface 26 of the support frame 14 when the frames 14, 16 are nested together in the display configuration, as illustrated in FIG. 1.

Figure 3:
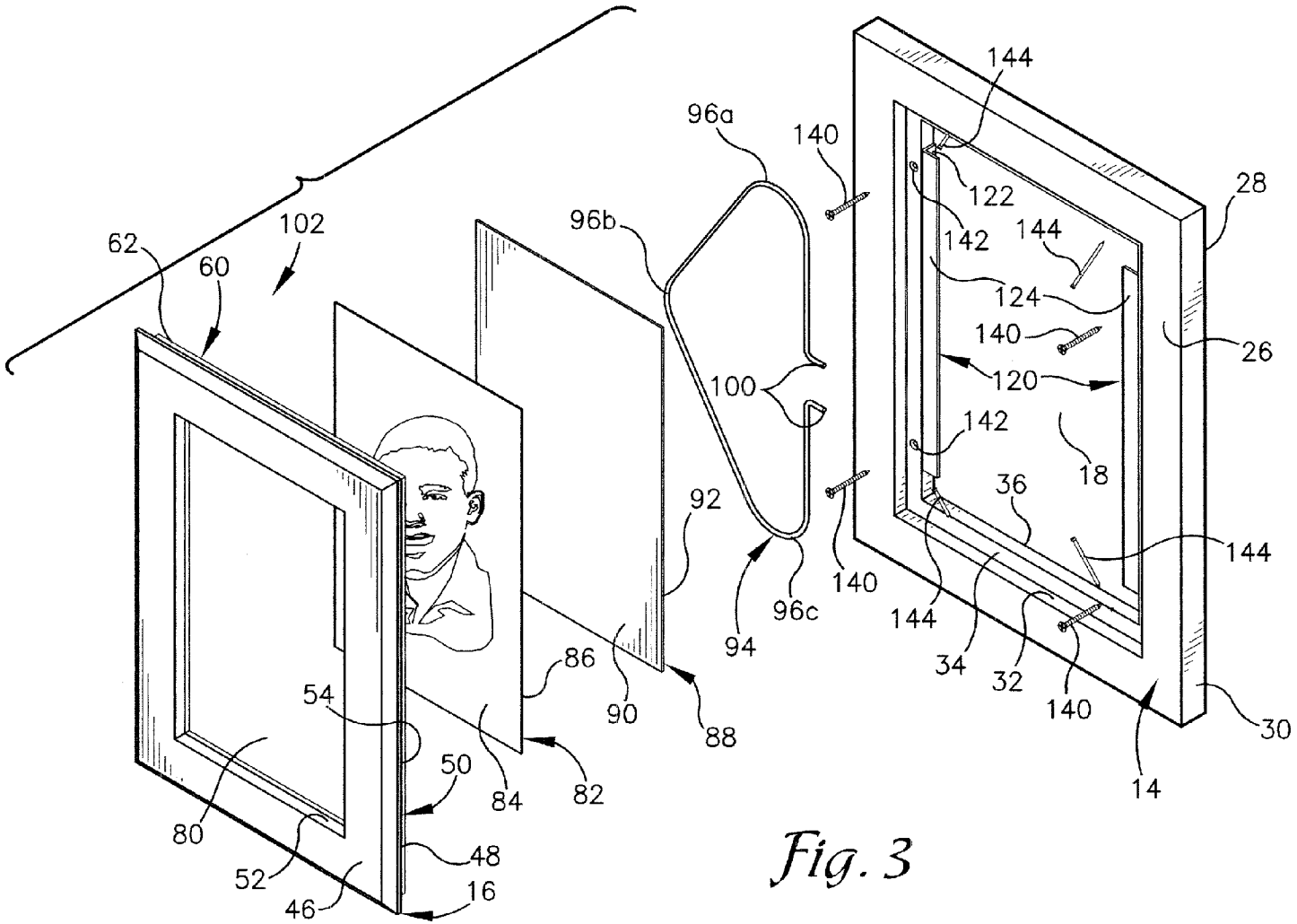
FIG. 3 is a front perspective view of the quick-exchange framing system illustrated in FIG. 1, illustrating the system in an exchange configuration.

An aperture or display-support cavity 80 extends through the display frame 16 and is cooperatively defined by the inner rear surface **48*b* and the interior side surface 64 of the protruding portion 60. The display-support cavity 80 is sized and shaped to receive an object to be displayed 82, an optional backplate 88, and an optional resilient wire fastener 94, which may be installed into a rear 102 of the display-support cavity 80 in this order when the system 10 is in the exchange configuration, as illustrated in FIG. 3. It is foreseen that the system 10 may be equipped with a protective transparent cover, such as a piece of glass, plexiglass, plastic, or the like, that is sized and shaped to entirely close the display-support cavity 80 and entirely cover the object to be displayed 82. If the cover is included in the system 10, the display-support cavity 80 receives the cover, the object to be displayed 82, the optional backplate 88, and the optional resilient wire fastener 94**, in this order.

The object to be displayed 82 is a photograph, in the exemplary embodiment, and includes opposing front and rear surfaces 84, 86, which are coplanar to each other. It is foreseen, however, that the object to be displayed 82 may be one or more pieces of artwork, such as pictures, paintings, photographs, and/or the like, and/or one or more documents, such as licenses and/or diplomas without deviating from the scope of the present invention. The object to be displayed 82 is preferably sized and shaped such that, when the object to be displayed 82 is installed in the display-support cavity 80, the front surface 84 of the object to be displayed 82 abuts the inner rear surface 48*b*.

Figure 4:
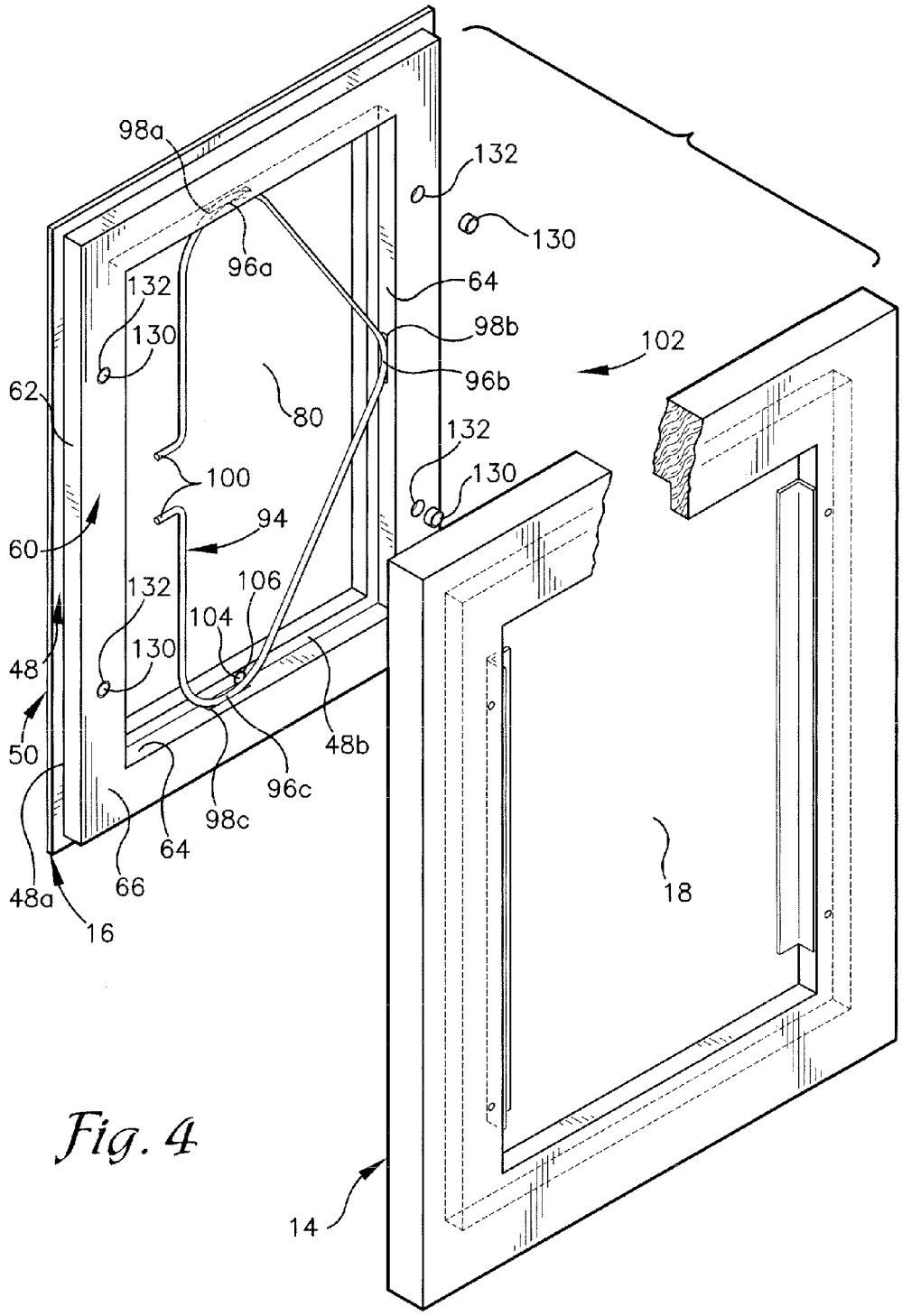
FIG. 4 is a rear perspective view of the quick-exchange framing system illustrated in FIG. 1, illustrating the system in an exchange configuration with a resilient wire fastener.

When present, the backplate 88 is removably mounted to the display frame 16 and in one or more embodiments, within the display-support cavity 80. The backplate 88 includes opposing front and rear surfaces 90, 92, which are coplanar to each other. The backplate 88 can be formed of a rigid magnetically-attractive material, such as metal or the like. It is foreseen, however, that the backplate 88 could be made of a non-ferrous metal, cardboard, plastic, or the like without deviating from the scope of the present invention. In one or more embodiments, the backplate 88 is sized and shaped to expand (preferably entirely) across the display-support cavity 80 such that, when the backplate 88 is installed in the display-support cavity 80, the front surface 90 of the backplate 88 abuts at least a portion of the rear surface 86 of the object to be displayed 82. In this manner, the backplate 88 traps the object to be displayed 82 within the display-support cavity 80 and against the inner rear surface 48*b* and the display-support cavity 80 is closed by the backplate 88. The backplate 88 also increases the structural integrity of the object to be displayed 82, which is beneficial if the object to be displayed 82 is made of paper or other flimsy material, and the system 10. As noted above, the backplate 88 is optional and may be omitted from the system 10 without deviating from the scope of the present invention. For instance, the system 10 may be used without the backplate 88 if the object to be displayed 82 is sufficiently rigid or if other means to fasten the object to be displayed 82 in the display-support cavity 80, such as, but not limited to the resilient wire fastener 94, as illustrated in FIG. 4, rotatable or bendable tabs, staples, magnets, and/or the like.

The resilient wire fastener 94 is a spring that is removably mounted to the display frame 16 and within the display-support cavity 80 via curved ends 96*a*, 96*b*, 96*c* of the resilient wire fastener 94. The ends 96*a*, 96*b*, 96*c* are sized and shaped to respectively extend into fastener-capture slots 98*a*, 98*b*, 98*c* located in and about the side surface 64 of the protruding portion 60 and spaced from the inner rear surface 48*b*, as illustrated in FIG. 4. The resilient wire fastener 94 can be made of a magnetically-attractive material, such as metal or other suitable material (e.g., plastic, composite, etc.) having a degree of resiliency, which permits the resilient wire fastener 94 to be converted to and from a normal decompressed configuration (which engages the side surface 64 of the protruding portion 60) and a compressed configuration (for removal). The resilient wire fastener 94 is converted from the decompressed configuration to the compressed configuration by pinching tips 100 of the resilient wire fastener 94, which causes the ends 96*a*, 96*c* to travel toward each other or retract inwardly. Due to the resiliency of the resilient wire fastener 94, the resilient wire fastener 94 automatically converts from the compressed configuration to the decompressed configuration when the tips 100 of the resilient wire fastener 94 are released, which causes the ends 96*a*, 96*c* to travel away from each other or extend outwardly.

To install the resilient wire fastener 94 into the display frame 16, the resilient wire fastener 94 is converted to the compressed configuration by pinching the tips 100, which causes the ends 96*a*, 96*c* to retract inwardly. With the ends 96*a*, 96*c* retracted, the end 96*b* is inserted into the slot 98*b* and the ends 96*a*, 96*c* are aligned with slots 98*a*, 98*c*, respectively. The resilient wire fastener 94 is then converted to the decompressed configuration by releasing the tips 100, which causes the ends 96*a*, 96*c* to extend into slots 98*a*, 98*c*, respectively. In this manner, the resilient wire fastener 94 is secured to the display frame 16 and within the display-support cavity 80. To remove the resilient wire fastener 94 from the display frame 16, the resilient wire fastener 94 is converted to the compressed configuration by pinching the tips 100, which causes the ends 96*a*, 96*c* to retract from the slots 98*a*, 98*c*, at which point, the end 96*b* is retracted from the slot 98*b*.

The resilient wire fastener 94 is sized and shaped to expand across the display-support cavity 80 such that, when the resilient wire fastener 94 is installed in the display-support cavity 80, the resilient wire fastener 94 abuts the rear surface 92 of the backplate 88. If the system 10 is used without the backplate 88, the resilient wire fastener 94 abuts the rear surface 86 of the object to be displayed 82. In this manner, the resilient wire fastener 94 traps the object to be displayed 82 and/or the backplate 88 within the display-support cavity 80 and against the inner rear surface 48*b* and the display-support cavity 80 is partially closed by the resilient wire fastener 94. As noted above, the resilient wire fastener 94 is optional and may be omitted from the system 10 without deviating from the scope of the present invention. For instance, the system 10 may be used without the resilient wire fastener 94 if the object to be displayed 82 is sufficiently rigid or if other means to fasten the object to be displayed 82 in the display-support cavity 80, such as, but not limited to the backplate 88, as illustrated in FIG. 5, rotatable or bendable tabs, staples, magnets, and/or the like.

To secure the backplate 88, the resilient wire fastener 94, and/or display media 82 in the display-support cavity 80 of the display frame 16, a plurality of magnets 104 can be mounted in a plurality of magnet receptacles 106 positioned along the inner rear surface 48*b*. The magnet and magnet receptacles 104, 106 are positioned such that, when the backplate 88, the resilient wire fastener 94, and/or object to be displayer 82 is installed in the display-support cavity 80, each of the magnets 104 align with and bias the backplate 88, the resilient wire fastener 94, and/or media 82 toward the inner rear surface 48*b* of the display frame 16 via a magnetic attraction. In the exemplary embodiment, the magnets 104 further secure the backplate 88 in the display-support cavity 80. If the system 10 is used without the backplate 88, the magnets 104 further secure the resilient wire fastener 94 and/or display media 82 in the display-support cavity 80, as illustrated in FIG. 4. If the system 10 is used without the resilient wire fastener 94, the magnets 104 further secure the backplate 88 in the display-support cavity 80, as illustrated in FIG. 5. Similarly, if the system 10 is used without the resilient wire fastener 94, or backplate 88, the magnets 104 secure display media 82 in the display-support cavity 80 with the aid of additional magnets or magnetically-attractive material placed behind the display media (not shown). It is foreseen that the magnets 104 may be of sufficient magnetic power to simultaneously secure both the backplate 88 and the resilient wire fastener 94 in the display-support cavity 80 without deviating from the scope of the present invention. It is also foreseen that the object to be displayed 82 may be of at least a partially magnetically-attractive material, in which case the backplate 88, the resilient wire fastener 94, and additional magnets are omitted and the object to be displayed 82 is self-secured within the display-support cavity 80 via a magnetic bond formed between the object to be displayed 82 and the magnets 104. It is also foreseen that the magnets 104 themselves could be formed of a magnetically-attractive material, such as metal, and the backplate 88 could be formed of at least a partially-magnetic material without deviating from the scope of the present invention or magnets could be mounted behind the object to be displayed 82 (in lieu of the backplate 88 or fastener 94), as mentioned above.

When the object to be displayed 82, the backplate 88, and the resilient wire fastener 94 are installed in the display-support cavity 80, the system 10 is converted to the display configuration by positioning the protruding portion 60 of the display frame 16 in the frame-support cavity 18 the frame 14. In this manner, the frames 14, 16 are nested together without requiring re-leveling of the system 10. With reference to FIG. 2, to further secure the frames 14, 16 together, a plurality of elongated strips 120 are mounted to the perimeter edge 36. Each of the strips 120 is made of a magnetically-attractive material, such as metal or the like, and includes a mount surface 122 and a magnet-abutment surface 124. Each of the mount surfaces 122 are secured to the perimeter edge 36 via screws, but it is foreseen that other attachment means may be used, such as nails, an adhesive, such as glue, or the like, without deviating from the scope of the present invention. Each of the magnet-abutment surfaces 124 extend perpendicular from the mount surface 122 and are flush with the recessed surface 34.

With references to FIG. 4, a plurality of magnets 130 are each installed in one of a plurality of magnet receptacles 132 along the rear abutment surface 66 of display frame 16. The plurality of magnet receptacles 132 are positioned such that the plurality of magnets 130 are aligned with the magnet-abutment surfaces 124 of the strips 120 when the display frame 16 is nested in the support frame 14. Thus, when the frames 14, 16 are nested in the display configuration, the plurality of magnets 130 are aligned with and magnetically attract the network of elongated strips 120, which causes the frames 14, 16 to be biased towards each other via a magnetic attraction formed between the plurality of magnets 130 and the network of elongated strips 120 or magnetic system. The magnetic bond formed between the frames 14, 16 may be overcome when the display frame 16 is pulled away from the support frame 14 in a direction generally perpendicular to a plane defined by the rear surface 28 of the support frame 14 via a pull force. It will be appreciated that the amount of force needed will depend upon the strength of the magnetic attraction, as well as the tightness of the fit of the support frame 14 and display frame 16. Due to the magnetic system, the support frame 14 and display frame 16 can be coupled using a loose-fit engagement. It is foreseen that the frames 14, 16 may be also mounted or coupled together using a friction-fit engagement in addition to or instead of the plurality of magnets 130 without deviating from the scope of the present invention.

With reference to FIG. 3, initial hard-mounting of the support frame 14 to the wall 12 can be accomplished via a plurality of screw fasteners 140 installed in pre-drilled apertures 142 that extend through the recessed surface 34. The support frame 14 can also be secured to the wall 12 via a plurality of nail fasteners 144 installed in pre-drilled apertures 146 that extend through the recessed surface 34. The fasteners 140, 142 are exposed through the frame support cavity 18 of the support frame 14 when the display frame 16 and the support frame 14 are disassembled with respect to each other. Thus, the fasteners 140, 142 are easily accessed through the front of the frame support cavity 18 during initial mounting and/or remounting operations of the system 10. This thru-frame mounting system provides a significant advantage in terms of being able to position, level, and mount the support frame to the wall 12 or other mounting surface, as compared to traditional hung frames. It is foreseen that the fasteners 140, 142 may be used as alternatives to each other or simultaneously, depending on mounting requirements of the system 10, without deviating from the scope of the present invention. The apertures 142, 146 are preferably drilled to permit countersinking of the fasteners 140, 142. It will be appreciated that the number of apertures 142, 146 is not limited, but will depend on the configuration and size of the system 10. It will also be appreciated that once the support frame 14 is mounted, the object 82 to be displayed can be exchanged without any further use of tools. It is foreseen that the system 10 may also use an optional leg or stand to permit use of the system on a table top or the like rather than on the wall 12 (or other vertical surface).

Figure 6:
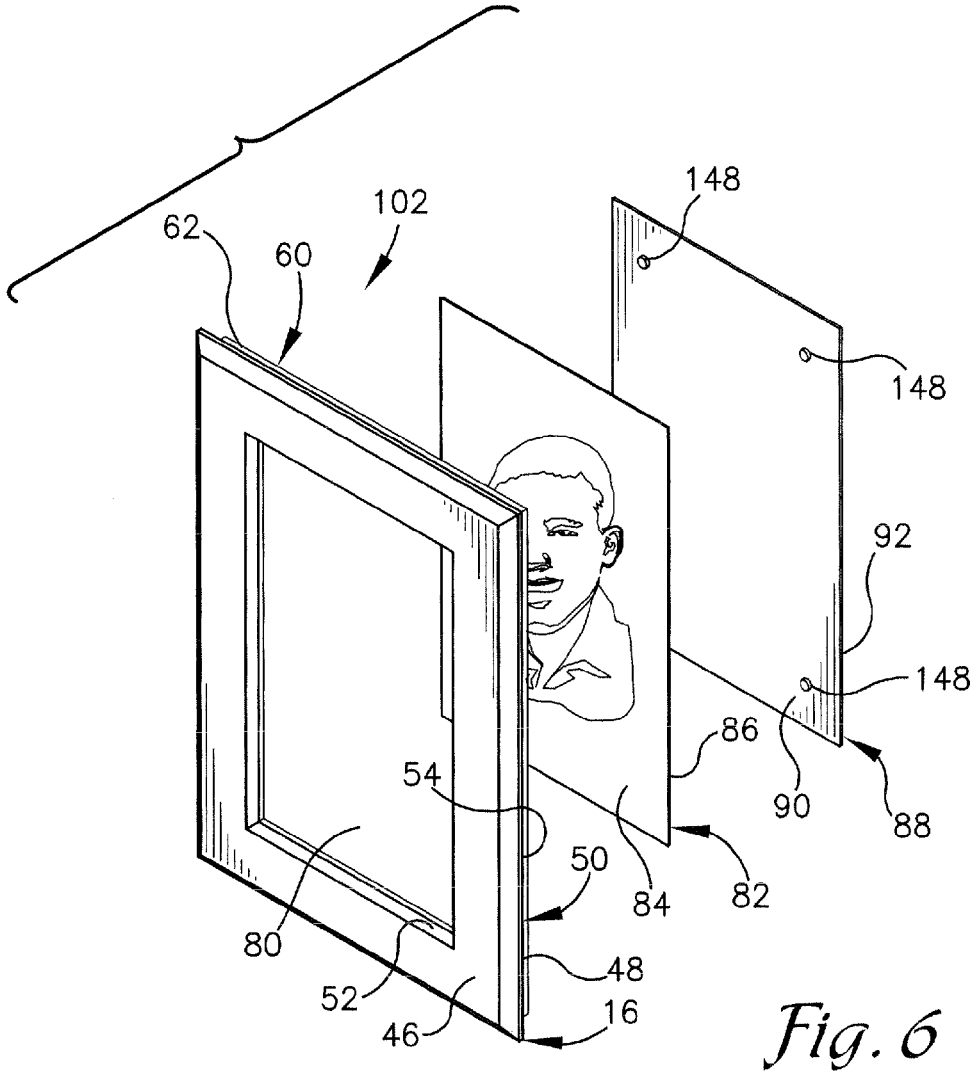
FIG. 6 is a front perspective view of the quick-exchange framing system illustrated in FIG. 1, illustrating the system in an exchange configuration with a mountable backplate.

With reference to FIG. 6, it is foreseen that the display frame 16 can be mounted to the wall 12 or other like surface using only the backplate 88. In this embodiment, the backplate 88 is sized and shaped to expand substantially entirely across the display-support cavity 80 such that, when the backplate 88 is coupled to the display frame 16, the front surface 90 of the backplate 88 abuts the rear surface 66 of the display frame 16, and specifically engages the magnets 130 (and/or 104) therein to magnetically secure the display frame to the backplate 88, which is semi-permanently mounted to the wall 12 or other mounting surface. A plurality of apertures 148 are provided in the backplate 88 so that the backplate 88 is a mountable backplate 88, which also features the advantageous thru-frame mounting system described elsewhere herein. The apertures 148 are sized and shaped to receive a fastener, such as a screw, nail, or the like. In this manner, the object to be displayed 82 may be displayed using only the display frame 16 and the backplate 88. It will also be appreciated that the backplate 88 could be sized to be much larger than the display frame 16, such that more than one display frame 16 could be magnetically coupled or mounted to the backplate 88, creating a collage.

The width and length of the frames 14, 16 will depend upon the size of the object to be displayed 82, but may each range anywhere from two to 160 inches. In a preferred embodiment, the system 10 is available in a variety of sizes including, but not limited to 3×5, 4×6, 5×7, 8×10, 11×14 inches, and the like. The frames 14, 16 may be made from any suitable material including wood, composite materials, such as MDF, trupan, epoxies, plastics, metal, metal alloys, stone, plaster, mortar, resin, concrete, hard paper products such as cardboard, glass, Plexiglas, fiberglass, and combinations thereof, etc., without departing from the scope of the invention. It will also be appreciated that in the discussion of magnetic attachments herein, the position of the magnets and the corresponding magnetically-attractive material could be reversed (i.e., a magnetically-attractive material could be located in the display frame, with the magnetic portion of the system being the backplate 88, the elongated strips 120, or even individual (unattached) magnets positioned behind the display frame 16. Alternatively magnets could be used for both portions of the system.

Accordingly, the present invention provides a quick exchange framing system that eliminates the need to re-level or re-hang the system 10 during exchange of the object to be displayed 82 via an exchange process that is easy and efficient.

As used herein, the phrase "and/or," when used in a list of two or more items, means that any one of the listed items can be employed by itself or any combination of two or more of the listed items can be employed. For example, if a composition is described as containing or excluding components A, B, and/or C, the composition can contain or exclude A alone; B alone; C alone; A and B in combination; A and C in combination; B and C in combination; or A, B, and C in combination.

Having now described the features, discoveries and principles of the general inventive concept, the manner in which the general inventive concept is constructed and used, the characteristics of the construction, and advantageous, new and useful results obtained; the new and useful structures, devices, tools, elements, arrangements, parts and combinations, are set forth in the appended claims.

It is also to be understood that the following claims are intended to cover all of the generic and specific features of the general inventive concept herein described, and all statements of the scope of the general inventive concept which, as a matter of language, might be said to fall therebetween.

The invention claimed is:

1. A media mount and display system comprising:

a support frame having a first receiver and opposing front and rear surfaces, wherein the first receiver at least partially defines a frame-support cavity extending through the front and rear surfaces of the support frame, wherein the first receiver includes a first interior sidewall and a first recessed surface extending from the first interior sidewall and spaced from the front surface by the first interior sidewall, wherein the first recessed surface includes an aperture that extends through the first recessed surface and is operable to receive a fastener through the front of the first recessed surface when the display frame and the support frame are in a disassembled configuration;

a display frame sized and shaped to be at least partially received by the first receiver of the support frame, the display frame having a second receiver operable to receive and display an object therein, wherein the first recessed surface and the first interior sidewall of the first receiver are cooperatively operable to abuttingly receive the display frame in an assembled configuration; and a magnetic system disposed between and operable to magnetically interconnect the support frame and the display frame relative to each other, the magnetic system operable to (i) securely maintain the support frame and the display frame when the display frame is at least partially received by the first receiver of the support frame in an assembled configuration, and (ii) permit disassembly of the display frame and the support frame when a separation force is applied to the magnetic system.

2. The media mount and display system of claim 1, wherein the display frame includes an exterior sidewall and rearwardly-protruding portion spaced from the exterior sidewall, the rearwardly-protruding portion sized and shaped to nest within the frame-support cavity.

3. The media mount and display system of claim 2, wherein the first recessed surface has a perimeter edge and wherein the magnetic system includes a first portion secured to the perimeter edge of the first recessed surface of the support frame and a second portion secured to the rearwardly-protruding portion of the display frame, the first and second portions of the magnetic system abutting each other in the assembled configuration.

4. The media mount and display system of claim 3, wherein the first portion of the magnetic system includes a network of magnetically-attractive elongated strips mounted to and substantially flush with the perimeter edge of the first recessed surface of the support frame.

5. The media mount and display system of claim 3, wherein the second portion of the magnetic system includes a network of magnets at least partially embedded in and substantially flush with the rearwardly-protruding portion of the display frame.

6. The media mount and display system of claim 1, wherein the second receiver of the display frame at least partially defines a display cavity that extends at least partially through a rear of the display frame.

7. The media mount and display system of claim 6, wherein the display cavity of the display frame includes a second interior sidewall and presents a second recessed surface spaced from the rear of the display frame by the second interior sidewall, the second recessed surface and the second interior sidewall operable to abuttingly receive an object therein.

8. The media mount and display system of claim 7, wherein the display frame includes a fastener operable to be received in a plurality of slots located in the second interior sidewall, the fastener operable to at least partially close the display cavity of the display frame to secure the object therein.

9. The media mount and display system of claim 8, wherein the object is one of (i) a plate, (ii) an object to be displayed, and (iii) a plate and an object to be displayed.

10. The media mount and display system of claim 1, wherein the separation force is applied to the magnetic system when the display frame is pulled away from the support frame in a direction perpendicular to a plane defined by the rear surface of the support frame.

11. The media frame and display system of claim 1, wherein the support frame includes a fastener through the aperture that is exposed through the first receiver of the support frame when the display frame and the support frame are disassembled.

12. A convertible media mount and display device comprising:

a support frame having a front surface, a rear surface, and a frame-support cavity extending at least partially through the front and rear surfaces of the support frame, wherein the frame-support cavity includes a first recessed surface spaced from the front surface of the support frame for abuttingly receiving a display frame, wherein the first recessed surface includes an aperture that extends through the first recessed surface and is operable to receive a fastener through the front of the recessed surface;

a display frame having a front surface and a rear surface, the rear surface including (i) a rearwardly-protruding portion sized and shaped to nest within the frame-support cavity abutting the recessed surface, and (ii) a receiver extending at least partially through the rear surface of the display frame, the receiver operable to receive and display an object therein; and a magnetic system disposed between the support frame and the display frame, the magnetic system operable to (i) maintain the device in an in-use configuration when the rearwardly-protruding portion of the display frame is nested with the frame-support cavity of the support frame, and (ii) permit conversion of the device from the in-use configuration to a non-use configuration when a force is applied to the magnetic system.

13. The device of claim 12, wherein the frame-support cavity of the support frame includes a first interior sidewall, wherein the first recessed surface is spaced from the front of the support frame by the first interior sidewall, the first recessed surface and the first interior sidewall operable to abuttingly receive the display frame in the in-use configuration.

14. The device of claim 12, wherein the display frame includes a second interior sidewall and presents a second recessed surface spaced from the rear of the display frame by the second interior sidewall, the second recessed surface and the second interior sidewall operable to receive therein one of (i) a plate, (ii) an object to be displayed, and (iii) a plate and an object to be displayed.

15. The device of claim 12, wherein the first recessed surface has a perimeter edge and wherein the magnetic system includes (i) a network of magnetically-attractive elongated strips mounted to and substantially flush with the perimeter edge of the first recessed surface of the support frame, and (ii) a network of magnets at least partially embedded in and substantially flush with the rearwardly-protruding portion of the display frame, the strips and the magnets abutting each other in the in-use configuration.

16. The device of claim 12, wherein the display frame includes a fastener operable to be received in a plurality of slots located in the second interior sidewall of the display cavity, the fastener operable to at least partially close the display cavity of the display frame to secure the object therein.

17. A method of manufacturing a media mount and display system, the method comprising the steps of:

forming a support frame having a front surface, a rear surface, and a frame-support cavity extending at least partially through the front and rear surfaces of the support frame, wherein the frame-support cavity includes a first recessed surface spaced from the front surface of the support frame for abuttingly receiving a display frame, wherein the first recessed surface includes an aperture that extends through the first recessed surface and is operable to receive a fastener through the front of the recessed surface;

forming a display frame having a front surface and a rear surface, the rear surface including (i) a rearwardly-protruding portion sized and shaped to nest within the frame-support cavity, and (ii) a receiver extending at least partially through the rear surface of the display frame, the receiver operable to receive and display an object therein; and disposing a magnetic system between the support frame and the display frame, the magnetic system operable to (i) maintain the device in an in-use configuration when the rearwardly-protruding portion of the display frame is nested with the frame-support cavity of the support frame, and (ii) permit conversion of the device from the in-use configuration to a non-use configuration when a force is applied to the magnetic system.

18. The method of claim 17, wherein the separation force is applied to the magnetic system when the display frame is pulled away from the support frame in a direction perpendicular to a plane defined by the rear surface of the support frame.

* * * * *